US009404332B2

(12) United States Patent
Melancon et al.

(10) Patent No.: US 9,404,332 B2
(45) Date of Patent: Aug. 2, 2016

(54) WELL SYSTEM WITH AN INDEPENDENTLY RETRIEVABLE TREE

(71) Applicant: Cameron International Corporation, Houston, TX (US)

(72) Inventors: Cole Melancon, Katy, TX (US); Venkatesh Baht, Houston, TX (US)

(73) Assignee: OneSubsea IP UK Limited, London (GB)

( * ) Notice: Subject to any disclaimer, the term of this patent is extended or adjusted under 35 U.S.C. 154(b) by 166 days.

(21) Appl. No.: 13/647,258

(22) Filed: Oct. 8, 2012

(65) Prior Publication Data

US 2014/0096975 A1 Apr. 10, 2014

(51) Int. Cl.

| | |
|---|---|
| ***E21B 43/01*** | (2006.01) |
| ***E21B 33/035*** | (2006.01) |
| ***E21B 7/12*** | (2006.01) |
| ***E21B 33/03*** | (2006.01) |
| ***E21B 33/04*** | (2006.01) |

(52) U.S. Cl.

CPC ..... *E21B 33/03* (2013.01); *E21B 33/04* (2013.01)

(58) Field of Classification Search

None

See application file for complete search history.

(56) References Cited

U.S. PATENT DOCUMENTS

| | | | | |
|---|---|---|---|---|
| 5,544,707 | A | 8/1996 | Hopper et al. | |
| 6,763,891 | B2 | 7/2004 | Humphrey et al. | |
| 6,942,028 | B2 | 9/2005 | Hosie | |
| 7,165,620 | B2 * | 1/2007 | Steedman | E21B 33/0385 166/344 |
| 7,240,736 | B2 * | 7/2007 | Fenton | B01D 17/0211 166/348 |
| 7,331,396 | B2 * | 2/2008 | Reimert | E21B 33/035 166/319 |
| 7,422,066 | B2 * | 9/2008 | Rodrigues | E21B 43/01 166/241.6 |
| 7,909,103 | B2 | 3/2011 | Fenton | |
| 8,061,428 | B2 * | 11/2011 | Fenton | E21B 33/04 166/339 |
| 2003/0141071 | A1 | 7/2003 | Hosie | |
| 2012/0111573 | A1 | 5/2012 | Bhat | |

OTHER PUBLICATIONS

International Search Report and Written Opinion dated Jan. 8, 2014 for PCT Application No.: PCT/US2013/063770 filed on Oct. 8, 2013.

* cited by examiner

*Primary Examiner* — Matthew R Buck
*Assistant Examiner* — Douglas S Wood
(74) *Attorney, Agent, or Firm* — Chamberlain Hrdlicka

(57) ABSTRACT

A well apparatus system that includes a wellhead, a tree, a tubing hanger, a tubing spool that is located between the wellhead and the tree, and a production isolator surrounded by the tree and the tubing spool. The tree component of this system can include a vertical or horizontal tree. More importantly, this system can be constructed in a number of different sequences. In addition, this well apparatus system allows for installation, retrieval, and/or work-over the tubing hanger and associated completion system without disturbance of the tree. The presented system also allows for installation and retrieval of the tree independent of the tubing hanger and associated completion system. Some embodiments can include valve-type mechanisms to serve as production environmental barriers. These mechanisms are integral to the production isolator.

18 Claims, 6 Drawing Sheets

WELL SYSTEM WITH AN INDEPENDENTLY RETRIEVABLE TREE

BACKGROUND

Conventionally, wells in oil and gas fields are built up with various components: a wellhead housing, a tubing hanger, a casing hanger, etc. Below those components is the drilled borehole for the well. Concentric casing strings are successively installed into the well to reinforce the drilled borehole. These casing strings are typically cemented at their lower ends and sealed with mechanical seal assemblies at their upper ends. Once drilled, the well is typically converted for production by landing a tubing hanger that supports a production tubing string. The production tubing string extends to the reservoir and provides a fluid pathway for directing hydrocarbons to the surface. At the surface, flow of the produced hydrocarbons from the reservoir is controlled by a series of valves that is colloquially called a Christmas tree (or tree).

Traditionally, there are two primary categories of trees—vertical and horizontal—that typically sit on top of the wellhead to control flow. In a vertical tree arrangement, the tree sits on top of a wellhead that supports the tubing hanger and, in turn, the production tubing string. The vertical tree has one or more production bores and contains valves extending vertically to respective lateral production fluid outlet ports in the wall of the tree.

Alternatively, the well may have a horizontal tree arrangement in which the tubing hanger is landed in the tree rather than the wellhead. A lateral production fluid outlet port in the tubing hanger is aligned with a corresponding lateral production port in the tree that leads to a production line, allowing for production through the tubing hanger and into the tree.

Each of these conventional arrangements has certain disadvantages. For example, to remove the production tubing string, which is supported by the tubing hanger landed in the wellhead, in a vertical tree arrangement, the vertical tree would have to first be removed, which can be costly and time consuming. With a horizontal tree, the tubing hanger that supports the production tubing string may be removed without removing the tree. But if it necessary to remove the tree, the tubing hanger and associated production tubing string is also removed.

BRIEF DESCRIPTION OF THE DRAWINGS

A better understanding of the various disclosed system and method embodiments can be obtained when the following detailed description is considered in conjunction with the drawings, in which.

DETAILED DESCRIPTION

Figure 1:
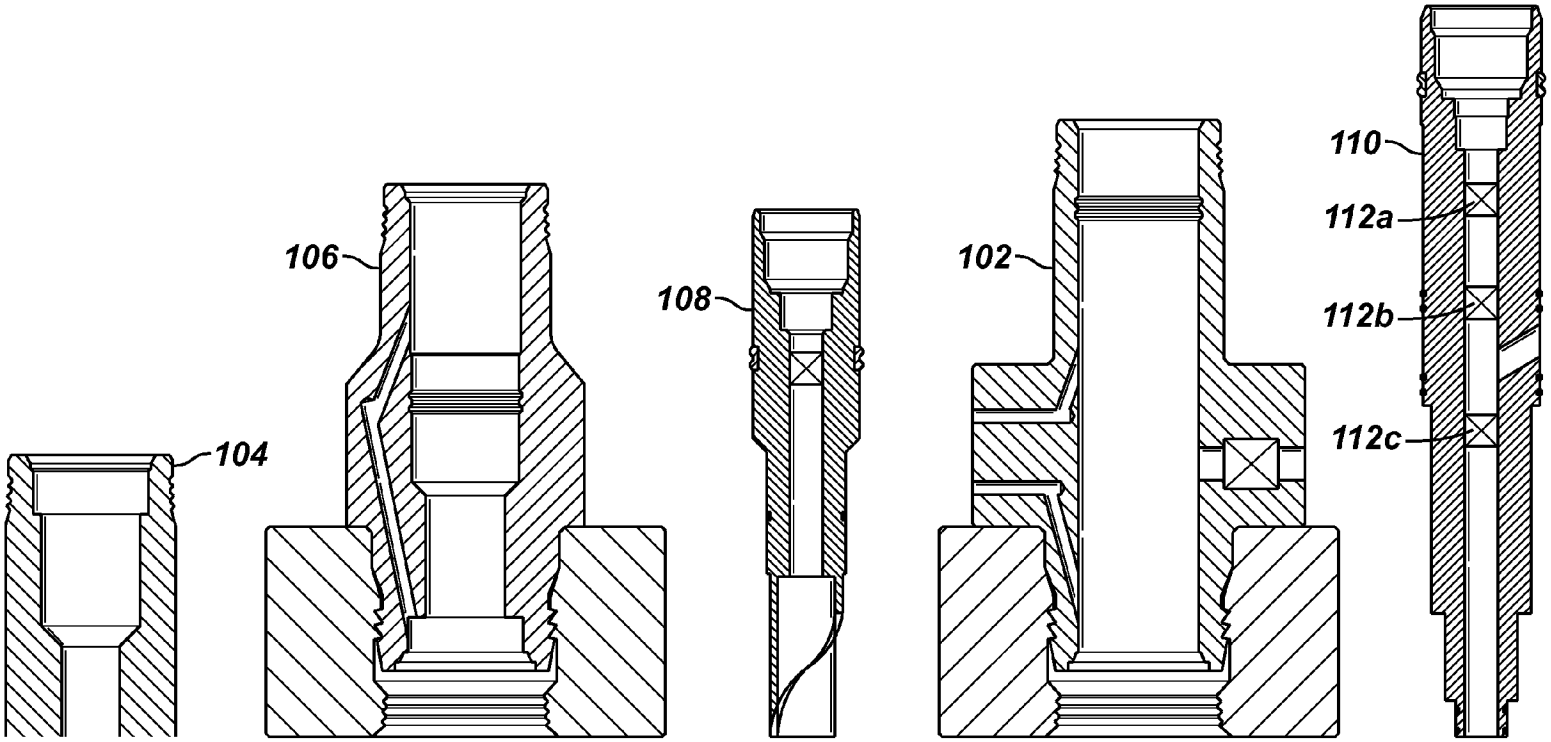
FIG. 1 shows illustrative components of the presented well system.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form, and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Accordingly, disclosed herein is a well system and sequences for construction of such. Some embodiments for a well system include a wellhead, a tree, a tubing hanger, a tubing spool located between the wellhead and the tree, and a production isolator connecting the tubing hanger production bore with the tree production outlet. The tree and production stab combination can be set up to operate as a production or horizontal tree. The tree can be changed in combination with the production isolator to operate like a horizontal or vertical tree, depending upon user preference. This system is designed such that the central bore of the tree is large enough for the tubing hanger to be installed and removed through the tree. Thus, the tubing hanger can be removed or installed independent of the tree. Furthermore, the tubing hanger sits within the tubing spool, and thus the tree can also be removed or installed independently of the tubing hanger and associated completion.

This well system can be constructed in a number of ways, providing ample flexibility in maintenance and operation of the well. One method embodiment includes connecting a tubing spool to a wellhead, installing a tubing hanger within the tubing spool, and then installing a tree and a production isolator simultaneously to the tubing spool.

A second method embodiment includes connecting a tubing spool to a wellhead, installing a tubing hanger within the tubing spool, installing a tree to the tubing spool, and then installing a production isolator within the tree.

A third method embodiment includes connecting a tubing spool to a wellhead, installing a tree to the tubing spool, installing a tubing hanger within the tubing spool through the tree, and finally, installing a production isolator within the tree. The system can be set up to operate either as a vertical or horizontal configuration A fourth method embodiment includes connecting a tubing spool to a wellhead, installing a tree to the tubing spool, and installing a production isolator and a tubing hanger simultaneously within the tubing spool through the tree.

FIG. 1 illustrates the multiple parts that supply the framework of the presented system, and are simply used to give a detailed explanation of the overall working environment. A tree 102 is used in this system and is an assembly of valves, spools, and fittings used to contain, control, and regulate the flow for an oil well or gas well. A tree as such can also be used for any type of well, including surface or subsea hydrocarbon well, a water injection well, a water disposal well, a gas injection well, a condensate well, and other types of wells. Trees are used on both surface and subsea wells. These trees can be identified as either a "subsea tree" or a "surface tree," and each of these classifications has a number of variations.

The primary function of the tree is to control, contain, and/or regulate the flow of fluids out of the well. A tree may also be used to control the injection of fluids into a non-producing well in order to enhance production rates of oil from other wells. When the well and facilities are ready to produce and receive oil or gas, tree valves are opened and the formation fluids are allowed to be produced through a flow line.

A wellhead 104 can be used without a tree 102 during drilling operations, and also for riser tie-back situations that later would have a tree installed at the top of the riser. However, the present system provides the flexibility to use and install the tree 102 independently in a number of different ways.

The wellhead 104 is the component at the surface of the well that provides the structural and pressure-containing interface for the drilling and production equipment. The primary purpose of the wellhead 104 is to provide the suspension point and pressure seals for the casing strings that run from the bottom of the hole sections to the surface pressure control equipment. Once the well has been drilled, it is completed to provide an interface with the reservoir rock and a tubular conduit for the well fluids. The surface pressure control is provided by the tree 102, which is normally installed on top of the wellhead 104, along with isolation valves and chokes equipment to control the flow of well fluids during production. The wellhead 104 can be welded onto the first string of casing, which is usually cemented in place during drilling operations, to form an integral structure of the well. The wellhead 104 provides a mechanism for casing suspension, tubing suspension, pressure sealing, etc.

More importantly, the wellhead provides a mechanism for attaching the tree 102.

Figure 2:
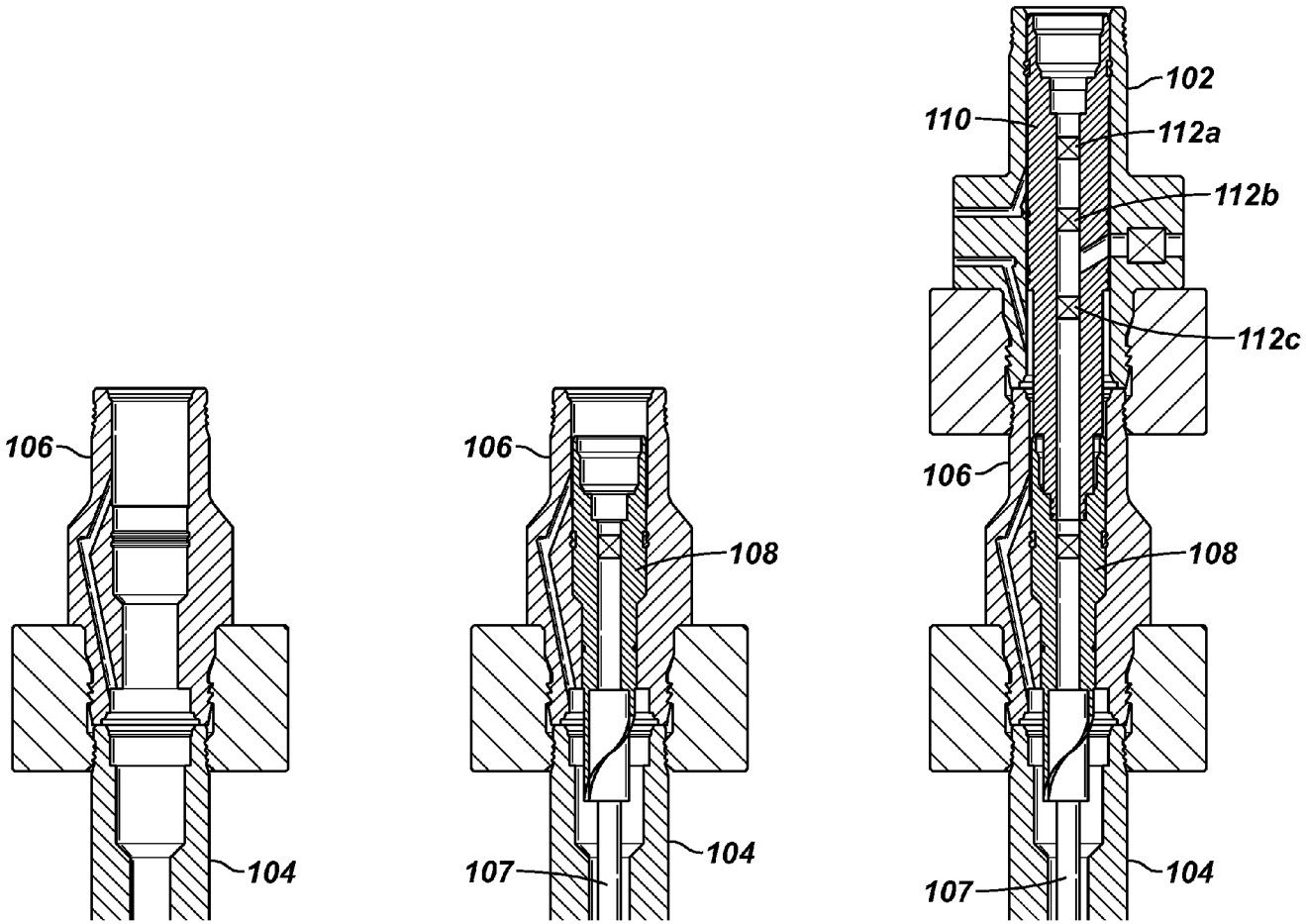
FIG. 2 is an illustrative sequence for construction of the well system.

The presented system also includes a tubing spool 106 connected to the top of the wellhead 104. Landed within the tubing spool 106 is a tubing hanger 108 with associated production tubing 107, as shown in FIG. 2. The tubing spool 106 includes a shoulder surface that the tubing hanger 108 lands on, making it possible to suspend a production tubing string 107, as shown in FIG. 2. The tubing spool 106 has a lateral opening through which oil, water, gas, air, or other fluids is fed into or from the annulus between the production casing string (the innermost casing string) and the production tubing in order to carry out production processes. A sealing and/or lock-down assembly is typically installed above the tubing hanger 108 to lock the tubing hanger in place and to ensure that the production tubing and annulus are hydraulically isolated.

The well system also includes a production isolator 110. The production isolator 110 can include production environmental barriers 112*a*, 112*b*, and 112*c* but need not include all three. For purposes of this discussion only, it will be assumed that all three barriers are used. These environmental barriers can be plugs that installed in the tree 102. The environmental barriers 112*a*, 112*b*, and 112*c* can also be a single valve or valve type mechanism integral to the production isolator 110. Retrieval of the production isolator 110 allows for retrieval of the environmental barriers 112*a*, 112*b*, and 112*c* simultaneously should they need servicing or replacement. The seals on the outside of the production isolator 110 that seal to the tree are also retrievable. Thus, all primary and secondary production barriers are retrievable at once. The production isolator is connected to the tubing hanger via a stab connection and ring seals. It is also possible to use a locking mechanism or any other suitable device for connecting the tubing hanger to the production isolator 110. Further, a fluid connection exists from the production tubing 107, through the production isolator, and to the production flowline of the tree.

FIG. 2 represents one of the multiple sequences of construction for the presented well system. In one embodiment, with the wellhead 104 already installed, the tubing spool 106 is connected to the wellhead 104, and the tubing hanger 108 is installed within the tubing spool 106. Finally, the tree 102 and the production isolator 110 are installed simultaneously; the tree 102 being connected to the tubing spool 106 and the production isolator 110 stabbing into and connecting with the tubing hanger 108.

Figure 3:
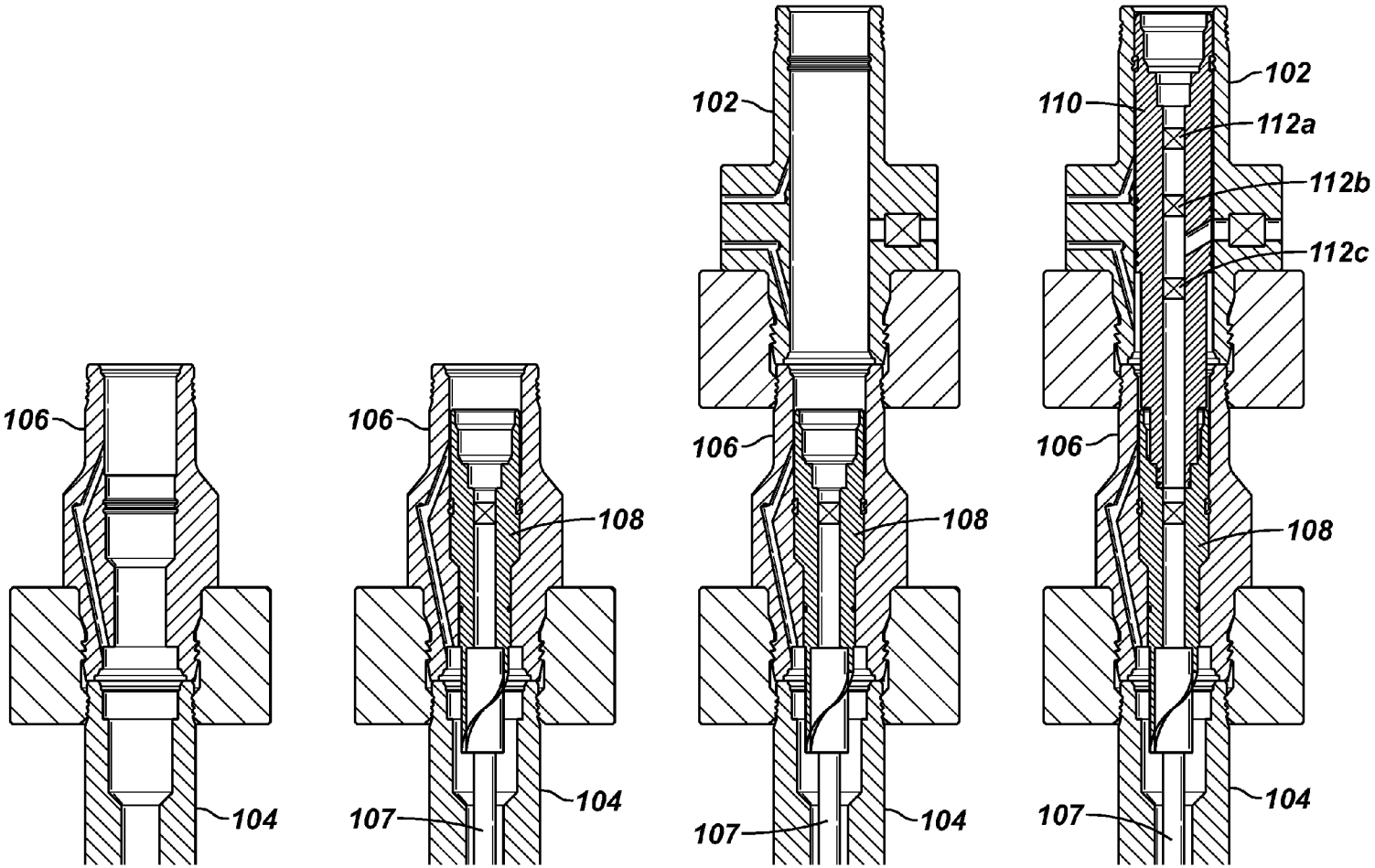
FIG. 3 is a second, illustrative sequence for construction of the well system.

FIG. 3 represents another method embodiment for constructing the well system. Here, the tubing spool 106 is connected to a wellhead 104, and a tubing hanger 108 is installed within the tubing spool 106. Next, the tree 102 is connected to the tubing spool 106. Finally, the production isolator 110 is installed within the tree 102.

Figure 4:
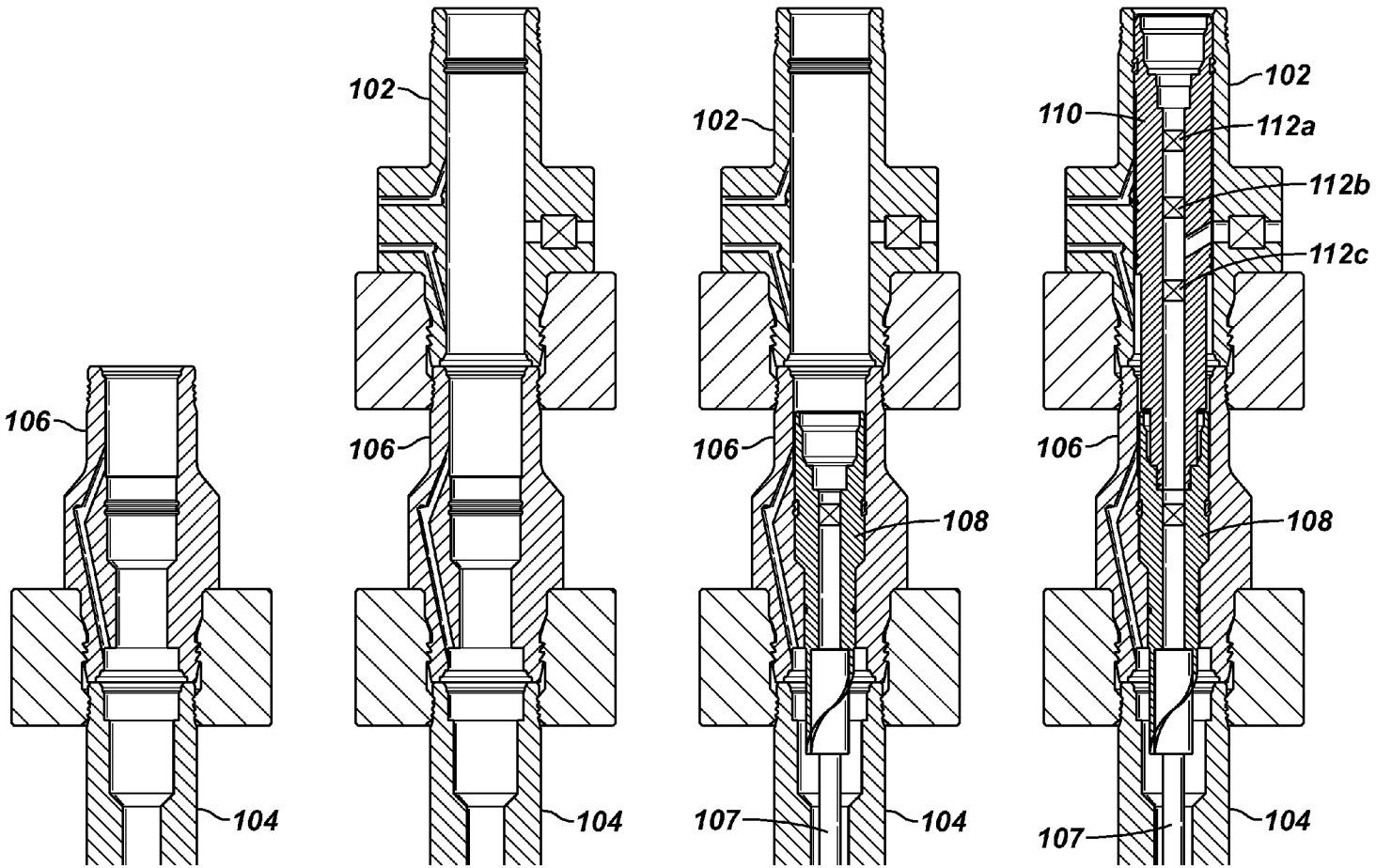
FIG. 4 is a third, illustrative sequence for construction of the well system.

FIG. 4 illustrates yet another method embodiment to constructing the presented well system. First, the tubing spool 106 is connected to a wellhead 104. Next, the tree 102 is connected and installed on the tubing spool 106. The tubing hanger 108 is then installed through the tree 102 and within the tubing spool 106. Finally, the production isolator 110 is installed within the tree 102.

Figure 5:
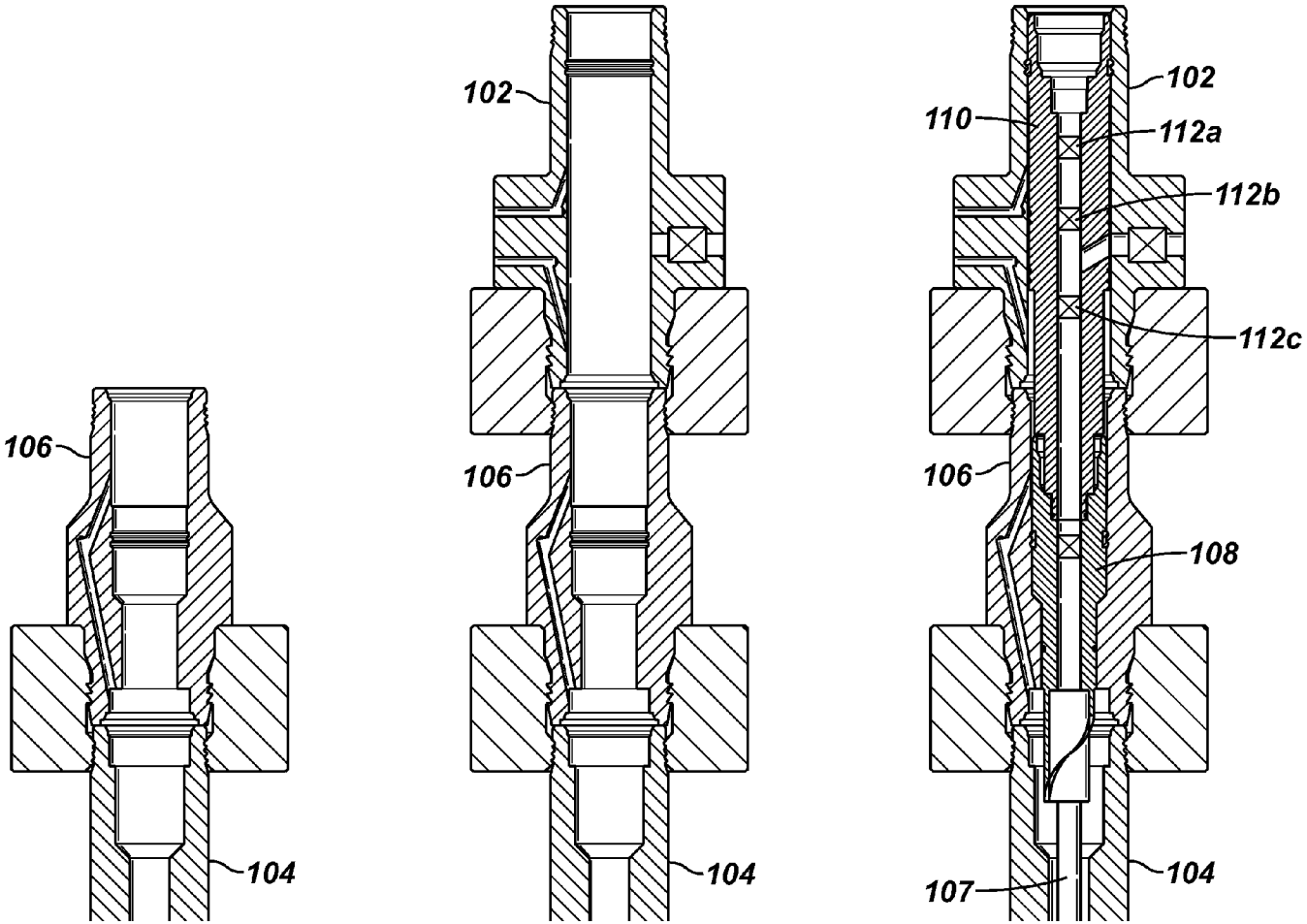
FIG. 5 is a fourth, illustrative sequence for construction of the well system.

FIG. 5 illustrates yet another method embodiment to constructing the presented well system. As shown in FIG. 5, first the tubing spool 106 is connected to a wellhead 104. Next, the tree 102 is connected and installed on the tubing spool 106. The tubing hanger 108 and the production isolator 110 are then both installed through the tree 102 and within the tubing spool 106 simultaneously.

Figure 6:
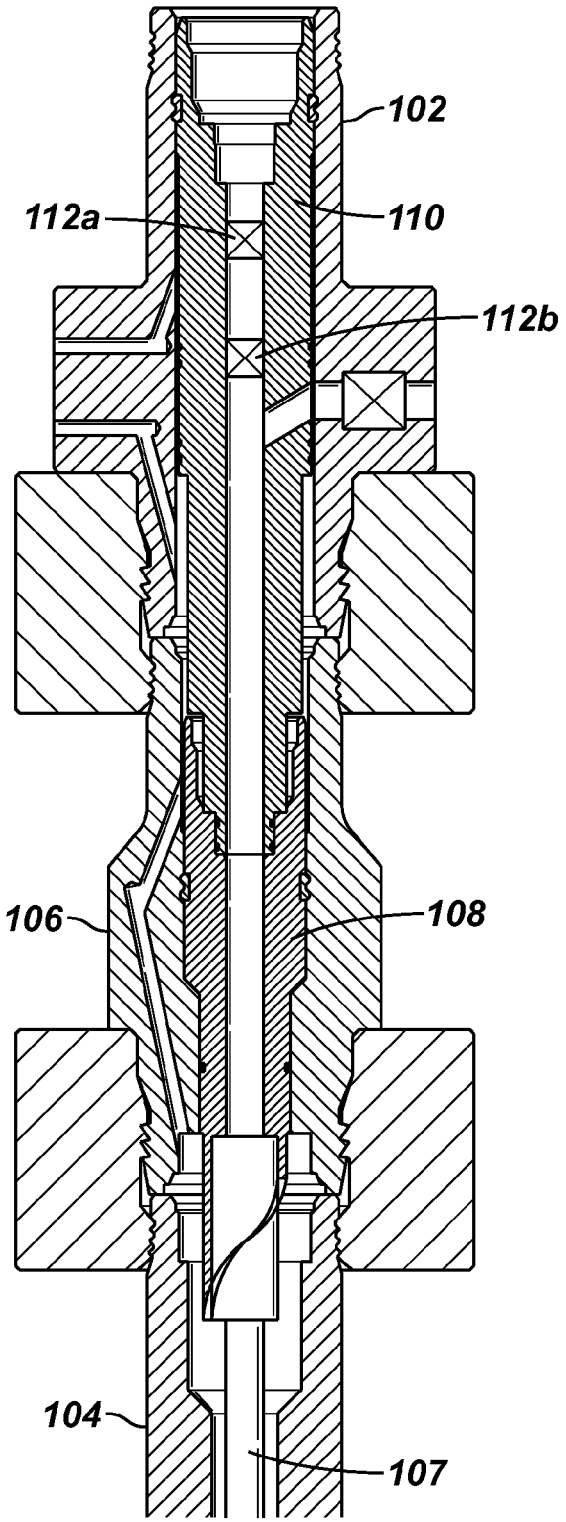
FIG. 6 is an illustrative final construction with barrier removed from the tubing hanger.

FIG. 6 shows a detailed view of the final production stackup of the well system, with the barrier removed in the tubing hanger 108. The lower barrier would have to be removed (in the case of a plug) or opened (in the case of a valve). Because of the multiple sequences, as presented in FIGS. 2-4 above, the presented system allows for installation and retrieval of the tubing hanger 108 and the associated completion system independent of the tree 102. The present system also allows for installation or retrieval of the tree 102 independent of the tubing hanger 108 and the associated completion system. Furthermore, the production isolator 110 can be run or retrieved with the tubing hanger 108 and associated completion system.

There are multiple advantages to the presented invention. The tree, as well as the tubing hanger, can be installed or retrieved independently of one another. This feature of the system saves both time and cost when only one of the two needs to be pulled. In addition, it minimizes interruption of the operation of the well. Additional safety barriers can also be utilized. Further, the system has the flexibility to be used in either a vertical or horizontal production setup. This system also allows direct access from the top of the vertical bore without removal of barriers. Direct access can be achieved through a fluid connection from the top of the tree that extends around and outside the production isolator and around (or outside) the tubing hanger into the annulus within the wellhead. The large bore of this system allows the ability to drill through the tree. Batch completions can be done before or after the tree is installed, and even allow for 7" bore to be sent through the tree.

Furthermore, no alignment of the tree to the tubing hanger spool is required; and no alignment of the production isolator to the tubing hanger or the tubing hanger spool is required. The production isolator is concentric with the vertical bore of the tree and is connected to the tubing hanger via a stab connection and ring seals. Thus, no alignment is needed from the production isolator to the tubing hanger. The tree is landed on the tubing spool and sealed via a stab connection.

Different embodiments for a well system and methods for constructing such systems are presented. The method embodiments provide flexibility for constructing, maintaining, and running the well system. For example, the tree and production isolator can be installed together, after installation of the tubing hanger. Another method embodiment can include installing the tubing hanger, tree, and production isolator separately in that order. Another embodiment can include installation of the tree, installation of the tubing hanger, and then installation of the production isolator. Other embodiments can include alternative variations.

These and other variations and modifications will become apparent to those skilled in the art once the above disclosure is fully appreciated. It is intended that the following claims be interpreted to embrace all such variations and modifications.

What is claimed is:

1. A well system for a well, the well system comprising:
- a wellhead;
- a production tree comprising a throughbore and a production outlet;
- a tubing spool comprising a throughbore, located between the wellhead and the production tree, and landable upon a top of the wellhead;
- a tubing hanger connected to a production tubing;
- a production isolator comprising a lateral throughbore in fluid communication with the production outlet;
- wherein the production isolator is connectable at any rotational alignment relative to the tubing spool;
- wherein the tubing hanger is removable and installable within the tubing spool through the production tree with the production tree connected to the tubing spool; and
- wherein the production tree is removable independent of the tubing hanger.

2. The well system of claim 1, wherein the production tree is installable independent of the tubing hanger.

3. The well system of claim 1, wherein the tubing hanger is landable within the tubing spool.

4. The well system of claim 1, wherein the tubing hanger is removable independently of the production tree.

5. The well system of claim 1, wherein the tubing hanger is installable independently of the production tree.

6. The well system of claim 1, wherein the production isolator is installed in the throughbore of the production tree and includes a production bore barrier.

7. The well system of claim 6, wherein the production bore barrier includes at least one of a plug and a valve.

8. The well system of claim 1, wherein the production tree and the tubing spool are installable before the tubing hanger is installed within the tubing spool.

9. The well system of claim 1, wherein the production isolator includes seals for sealing engagement with the tubing hanger.

10. The well system of claim 1, wherein the production isolator is installable above the tubing hanger.

11. The well system of claim 1, wherein the production isolator can be installed with the tubing hanger.

12. The well system of claim 1, further comprising:
- a production casing string extending into the well outside of the production tubing, there being an annulus between the production tubing and the production casing string; and
- the production tree and the tubing spool including a flowline in fluid communication with the annulus.

13. The well system of claim 1, wherein the production tree can be connected to the tubing spool at any rotational alignment.

14. The well system of claim 1, wherein the production tubing is in fluid communication with the production outlet laterally through the production isolator at any rotational alignment of the production isolator relative to the tubing spool.

15. A subsea production system, including:
- a production tree comprising a vertical throughbore and a production outlet;
- a tubing spool comprising, a vertical throughbore, attachable to the production tree, and landable upon a top of a wellhead;
- a production isolator disposed within the production tree, the production isolator comprising a vertical throughbore and a lateral throughbore in fluid communication with the production outlet, wherein the production isolator is connectable at any rotational alignment relative to the tubing spool;
- wherein the production tree vertical throughbore is large enough to allow passage of a tubing hanger supportable by the tubing spool without removing the production tree from the tubing spool;
- wherein the tubing hanger is removable and installable within the tubing spool through the production tree with the production tree connected to the tubing spool; and
- wherein the production tree is removable independent of the tubing hanger.

16. The system of claim 15 further comprising the production tree and the production isolator being installable separately.

17. A method for constructing a well system, comprising:
- landing a tubing spool upon a top of a wellhead;
- installing a tubing hanger within the tubing spool;
- installing a production tree comprising a production outlet to the tubing spool; and
- installing a production isolator comprising a lateral throughbore within the production tree to establish fluid communication between the production outlet and the lateral throughbore;
- wherein the production isolator is connectable at any rotational alignment relative to the tubing spool;

wherein the tubing hanger is removable and installable within the tubing spool through the production tree with the production tree connected to the tubing spool; and wherein the production tree is removable independent of the tubing hanger.

18. The method of claim 17, further comprising removing the production isolator and the tubing hanger through the production tree without removing the production tree from the tubing spool.

* * * * *